US006412298B2

(12) United States Patent
Kang et al.

(10) Patent No.: US 6,412,298 B2
(45) Date of Patent: Jul. 2, 2002

(54) WINDOW TYPE AIR CONDITIONER

(75) Inventors: Dong Joon Kang; Soon Hwan Oh, both of Kyongsangnam-do; Ju Hyun Jung, Pusan-shi; Cheung Hyun Bae, Kyongsangnam-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/842,904

(22) Filed: Apr. 27, 2001

(30) Foreign Application Priority Data

| | | |
|---|---|---|
| Apr. 29, 2000 | (KR) | 00-23060 |
| Jan. 6, 2001 | (KR) | 01-865 |
| Jan. 6, 2001 | (KR) | 01-866 |
| Jan. 6, 2001 | (KR) | 01-876 |

(51) Int. Cl.[7] ..... F25D 23/12
(52) U.S. Cl. ..... 62/262; 62/298
(58) Field of Search ..... 62/262, 298; 454/201, 454/202

(56) References Cited

U.S. PATENT DOCUMENTS

| | | | | |
|---|---|---|---|---|
| 4,240,264 A | * | 12/1980 | Nakada et al. | 62/125 |
| 5,193,355 A | * | 3/1993 | Matsumi | 62/262 |
| 5,203,400 A | * | 4/1993 | Tsunekawa et al. | 165/59 |
| 6,032,479 A | * | 3/2000 | Choi et al. | 62/262 |
| 6,182,460 B1 | * | 2/2001 | Hernandez et al. | 62/262 |

* cited by examiner

*Primary Examiner*—Denise L. Esquivel
*Assistant Examiner*—Melvin Jones
(74) *Attorney, Agent, or Firm*—Birch, Stewart, Kolasch & Birch, LLP

(57) ABSTRACT

Window type air conditioner including an indoor heat exchanger for heat exchange with room air, an outdoor heat exchanger for heat exchange with external air, an air guide for partitioning a space for fitting the indoor heat exchanger and a space for fitting the outdoor heat exchanger, a turbo fan fitted inside of the air guide directly, for discharging the room air heat exchanged as the room air passes through the indoor heat exchanger into the room, again, and a fan fitted to outside of the air guide for discharging the external air heat exchanged as the external air passes through the outdoor heat exchanger again, thereby permitting uniform discharge of cooled air from an outlet while a structure is made simple, improving a strength as the structure is simple, and preventing air leakage between indoor side components as assembly between the orifice and the air guides are made accurate.

20 Claims, 12 Drawing Sheets

WINDOW TYPE AIR CONDITIONER

BACKGROUND OF THE INVENTION

1. Field of the Invention

The present invention relates to an air conditioner, and more particularly, to a window type air conditioner which has a simple structure, and is easy to assemble.

2. Background of the Related Art

FIG. 1 illustrates a disassembled perspective view of a related art window type air conditioner, referring to which the related art window type air conditioner will be explained.

There is a front grill 3 in front (a room side) of a base pan 1, at the bottom of the air conditioner. There is an inlet 3*i*for passage of room air into the air conditioner, disposed in a lower portion of the front grill 3, and an outlet grill 3*e* in an upper portion of the front grill 3 for discharging the air heat exchanged in the air conditioner to the room again. There is a suction grill (not shown) fitted to the inlet 3*i* and a filter (not shown) between the suction grill and the inlet 3*i*. There is an air guide 7 on an inner side of the front grill 3, to which an indoor heat exchanger 5 is mounted. The indoor heat exchanger 5 cools down the air drawn through the inlet 3*i* by means of heat exchange with an operative fluid in an air conditioning cycle. The air guide 7 fitted on the base pan 1 partitions an inside space of the air conditioner into an indoor side and an outdoor side. That is, the indoor side is isolated from the outdoor side by the air guide 7, to cut off air flow and the like. There is a shaft hole 7' formed in the air guide 7 to join the indoor side and the outdoor side by passing a rotating shaft of a motor 15 to rotate a sirocco fan 13. There is a brace 7B on an upper portion of the air guide 7 formed as one unit with the air guide 7 for fastening shroud 18 of a fan thereto. There is a control box storage space 8 in one side portion of the air guide 7 for storing a control box (not shown). There is a scroll 9 mounted inside of the air guide 7. The scroll 9 has a flow guide surface 9*g* formed therein with a curvature from one side to the other side. There is an orifice 11 fitted to a front surface of the scroll 9, and the orifice 11 has an orifice hole 12 for guiding air from the indoor heat exchanger 5 to the sirocco fan 13. There is a discharge guide 11*e* on top of the orifice 11 as one unit with the orifice 11 for guiding the heat exchanged air to the discharge grill 3*e*. Middle of a rear part of the discharge guide 11*e* is opened, and there are coupling parts 11' at the opened part each for coupling with a top portion of the air guide 7. There is a finger guard 'F' in a rear portion of the discharge guide 11*e* for blocking touch to the sirocco fan 13. There is a projection 'E' of ESP at one side of the discharge guide 11*e* for blocking view to a white colored scroll 9 from outside. As explained, there is the discharge guide 11*e* on the orifice 11, the orifice 11 is inserted between the indoor heat exchanger 5 and the sirocco fan 13 starting from an upper portion to a lower portion, i.e., in a top-down fashion. The sirocco fan 13 inside of the scroll 9 causes air to flow through the inlet 3*i*, indoor heat exchanger 5, and the orifice hole 12. The sirocco fan 13 causes air to be drawn through the orifice hole 12 and flowed along a circumference thereof. The air flowed along the circumference is guided along a flow guide surface 9*g* and flows toward the discharge guide 11*e*.

The description up to now is for the indoor side of the window type air conditioner, and hereafter the outdoor side of the window type air conditioner will be explained.

There is a motor 15 fitted on an outdoor side (rear side) of the air guide 7 for rotating the sirocco fan 13 and the fan 17. The motor 15 has a rotating shaft projected in front and rear directions, one of which is passed through the air guide 7, projected up to a center of the scroll 9, and coupled with the sirocco fan 13, and the other of which on the outdoor side is coupled with the fan 17 for drawing air from outside of the air conditioner and passed through the indoor heat exchanger 19 for heat exchange. The fan 17 has a ring 17*r* for connecting end edges of the blades. There is a fan shroud 18 fitted on the base pan 1 for guiding air flow from the fan 17. The fan shroud 18 has a hole 18' in communication with the outdoor heat exchanger 19. The outdoor heat exchanger 19 is fitted on an outside portion of the base pan 1 opposite to the fan shroud 18. Though not shown, there are a compressor, an expansion valve, and the like, components of an air conditioning cycle, fitted to the outside portion. The different components of the air conditioner are enclosed by an outer case 20 which forms an outer cover of the air conditioner. For the window type air conditioner, the indoor portion is placed in a space for air conditioning and the outdoor portion is placed on the outside of the room.

The operation of the air conditioner will be explained.

Upon putting the air conditioner into operation, the air conditioning cycle comes into operation, and the motor 15 rotates the sirocco fan 13 as well as the fan 17. According to this, room air is provided to the indoor heat exchanger 5 through the inlet 3*i*. The air undergoes a temperature drop as the air passes through the indoor heat exchanger and exchanges heat with the operation fluid. The air is then provided to the sirocco fan 13 through the orifice hole 12. The air drawn into the sirocco fan 13 is guided along a circumferential direction of the sirocco fan 13 and discharged therefrom. Then, the air is guided along a flow guide surface 9*g* of the scroll 9 and provided to the discharge guide 11*e*. The low temperature air provided to the discharge guide 11*e* is discharged into the room through the discharge grill 3*e*. In the meantime, on the outdoor side, the operation for discharging heat from the operation fluid received from the indoor heat exchanger 5 is in progress. That is, external air drawn by the fan 17 is heat exchanged with the operation fluid as the air passes through the outdoor heat exchanger 19, to discharge the heat to outside of the air conditioner.

However, the foregoing window type air conditioner has the following problems.

First, the related art window type air conditioner uses the sirocco fan 13 for drawing room air. The sirocco fan, designed for a high rate of air flow has numerous short blades, each curved opposite to a direction of rotation, requires the scroll 9 and an additional air guide for forming an air flow. This causes various problems. In particular, the air is discharged from the sirocco fan 13 in a circumferential direction throughout the flow guide surface 9*g*. Therefore, the air discharged to an upper stream of the flow guide surface 9*g* continues to flow along the flow guide surface 9*g* and is involved in a pressure build up as the air goes to a downstream, providing resistance to rotation of the sirocco fan 13. Moreover, as the air is concentrated at the downstream portion of the flow guide surface 9*g*, the air flows partially to one side of the discharge guide 11*e*. At the end, the air discharge is not uniform throughout the discharge grill 3*e*.

Second, the discharge guide 11*e* assembled on the air guide 7 and the scroll 9 is formed on the orifice 11 as one unit with the orifice 11, requiring orifice 11 to be put into place after the air guide 7 and the scroll 9 are assembled, and requiring assembly of the discharge guide 11*e* and the air guide at the same time as assembly of the orifice 11. Therefore, the assembly has been very inconvenient.

Moreover, the unitized orifice 11 and discharge guide 11*e* puts many limitations on the formation of the orifice itself.

Third, the top-down fashion assembly of the orifice 11 puts limitations on the shape of the sirocco fan 13, a counter part of the orifice 11. In particular, the orifice 11 fitted in front of the sirocco fan 13 is required to provide the air passed through the indoor heat exchanger 5 to the sirocco fan 13 accurately without leakage. Therefore, when the orifice 11 and the sirocco fan 13 are assembled in top-down fashion, facing surfaces of the sirocco fan 13 and the orifice 11 has to be flat to bring them into contact. Moreover, even if the facing surfaces of the orifice 11 and the sirocco fan 13 are formed flat to bring them into contact, a gap between the orifice 11 and the sirocco fan 13 having different tolerances, causes air leakage.

Fourth, the discharge guide 11*e* formed on the orifice 11 as one unit with the orifice 11 is weak in strength, because the coupling parts 11' coupled with the top of the air guide 7 are separated from each other. Defective assembly coming from distorted coupling parts 11' shakes during operation of the air conditioner, to generate noise from this part.

Lastly, the air guide 7 unitized with the brace 7B and the control box storage space 8 is not easy to form. That is, the unitization of many components to form a large body causes difficulty in formation of a mold, and production of the air guide 7.

SUMMARY OF THE INVENTION

Accordingly, the present invention is directed to a window type air conditioner that substantially obviates one or more of the problems due to limitations and disadvantages of the related art.

An object of the present invention is to provide a window type air conditioner which has a simple construction and discharges cooled air from a discharge part uniformly.

Another object of the present invention is to provide a window type air conditioner which can improve convenience of assembly.

A further object of the present invention is to provide a window type air conditioner which has an air guide, a simple structure, and an improved strength.

A still further object of the present invention is to provide a window type air conditioner which causes no air leakage between indoor side components as assembly between an orifice and an air guide that guides air flow on the indoor side is precise.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof, as well as the appended drawings.

To achieve these and other advantages and in accordance with the purpose of the present invention, as embodied and broadly described, the window type air conditioner includes an indoor heat exchanger for heat exchange with room air, an outdoor heat exchanger for heat exchange with external air, an air guide for partitioning a space for fitting the indoor heat exchanger and a space for fitting the outdoor heat exchanger, a turbo fan fitted inside of the air guide directly, for discharging the room air heat exchanged as the room air passes through the indoor heat exchanger and a fan fitted to outside of the air guide for discharging the external air heat exchanged as the external air passes through the outdoor heat exchanger.

The air guide includes a partition plate having the turbo fan fitted in a central portion and partitioning the indoor heat exchanger and the outdoor heat exchanger, and sidewall parts at both sides of the partition plate substantially perpendicular to the partition plate.

Preferably, the window type air conditioner further includes an orifice between the indoor heat exchanger and the turbo fan for effectively directing passed through the indoor heat exchanger. The orifice includes a partition wall having an orifice hole formed therein for passing the air therethrough, and coupling parts formed at both sides of, and substantially perpendicular to the partition wall having one side coupled to both ends of the indoor heat exchanger, and the other end coupled to both ends of the air guide.

Preferably, the window type air conditioner further includes a discharge guide on the air guide for effectively directing air from the turbo fan to the room. The discharge guide includes a horizontal member having a discharge part, and a partition part at a rear end thereof, and substantially perpendicular to the horizontal member for partitioning an indoor side and an outdoor side.

Thus, the window type air conditioner of the present invention dispenses with separate air flow means, such as the scroll in the related art, and maintains a uniform flow rate owing. to the use of the turbo fan, and to have a simple air conditioner structure, and improved strength, and ease of assembly.

In another aspect of the present invention, there is provided a window type air conditioner including an indoor heat exchanger for heat exchange with room air, an outdoor heat exchanger for heat exchange with external air, a lower air guide for separating a space the indoor heat exchanger is mounted therein from a space the outdoor heat exchanger is mounted therein, an orifice fitted at a front of the lower air guide for guiding the air passed through the indoor heat exchanger to an inside of the lower air guide, an upper air guide mounted at the top of the lower air guide to make surface to surface contact with the orifice and the upper air guide, a turbo fan directly fitted to an inside of the lower air guide for discharging the air being heat exchanged as the air passes through the outdoor heat exchanger into a room, and a fan fitted outside of the lower air guide for discharging the air being heat exchanged as the air passes through the outdoor heat exchanger to outside of room.

The orifice includes an orifice hole formed at a central portion thereof for directing air flow, and a seating step formed along the top thereof with a step, and the upper air guide formed to mate with the seating step, such that the upper air guide includes a seating ridge having a lower end for seating on the seating step, and a side for making close contact with a side of the seating step.

The seating step formed in top of the orifice includes a round part, and the upper air guide includes a round part at a lower surface thereof matched to the round part of the seating step in the orifice, and insertion guides formed on the round part on the lower surface of the upper air guide matched to the round part of the upper air guide for guiding insertion of the seating step and supporting the seating step.

The upper air guide includes end insertion guides in positions matched to the seating ridge for guiding insertion of both ends of the top of the orifice, and maintaining a coupled state firmly after coupling.

In a further aspect of the present invention, there is provided a window type air conditioner including an indoor heat exchanger for heat exchange with room air, an outdoor heat exchanger for heat exchange with external air, a lower air guide for separating a space the indoor heat exchanger is mounted therein from a space the outdoor heat exchanger is mounted therein, an orifice fitted at a front of the lower air guide for guiding the air passed through the indoor heat exchanger to an inside of the lower air guide, an upper air guide assembled to a top of the lower air guide to make surface to surface contact with the orifice and the upper air guide, leakage preventing means provided at matched positions of a rear wall of the lower air guide and a rear wall of the upper air guide, the rear wall of the lower air guide being provided for partitioning an indoor side and an outdoor side, and the rear wall of the upper air guide is provided for partitioning an indoor side and an outdoor side, a turbo fan directly fitted to an inside of the lower air guide for discharging the air being heat exchanged as the air passes through the indoor heat exchanger into a room, and a fan fitted outside of the lower air guide for discharging the air having a heat exchanged as the air passes through the outdoor heat exchanger to the outside of the room.

The leakage preventing means includes a holding slot opened in a horizontal direction in a central top surface of the rear wall of the lower air guide, a holding piece projected backward from the rear wall of the upper air guide at a position matched to the holding slot for being held by the holding slot in the lower air guide, a sealing ridge extended along the top of the rear wall of the lower air guide, an insertion slot in a bottom surface of the rear wall of the upper air guide at a position matched to the sealing ridge for insertion of the sealing ridge thereto, reinforcing ribs at top of the control box seating part opposite to each other, and insertion ribs at positions matched to the reinforcing ribs for inserting between the reinforcing ribs.

The upper air guide includes opposite supporting ribs on one side of a bottom surface thereof for insertion into the pipe seating part of the lower air guide to support between the control box seating part and one sidewall of the lower air guide.

The leakage preventing means further includes a sill projected from a lower surface of, and extended in left and right directions on the lower air guide, an overlap part having a seating part formed as a step to make surface to surface contact with the sill for seating on a top of the sill, and a stopper for guiding the overlap part toward the sill, and supporting the overlap part toward the sill when coupled.

The leakage preventing means further includes sealing plates formed on both sides of the orifice in up and down directions for making close contact with sides of the lower air guide, and a sloped sealing strip formed on a rear surface of the orifice in a form to be matched to guide surface formed in an inside space of the lower air guide for making surface to surface contact with the guide surface.

The leakage preventing means further includes catch projections formed on both sides of the lower air guide, catch holes formed in the sealing plates of the orifice to be matched with the catch projections, and another catch projections on a back surface of the orifice opposite to the sealing plates, each with a gap to the sealing plate the same with a thickness of the sidewall of the lower air guide.

The leakage preventing means further includes toes on lower ends of the orifice for covering both ends of the catches on the lower air guide to prevent air leakage.

The orifice further includes sealing ridges projected forward from both sides of the orifice for making close contact with channels on both sides of the indoor heat exchanger.

The sealing ridge includes a plurality of reinforcing stoppers for maintaining straightness of the sealing ridges and defining a mounting position of the indoor heat exchanger, to prevent gap formation between the channel of the indoor heat exchanger and the sealing ridge.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
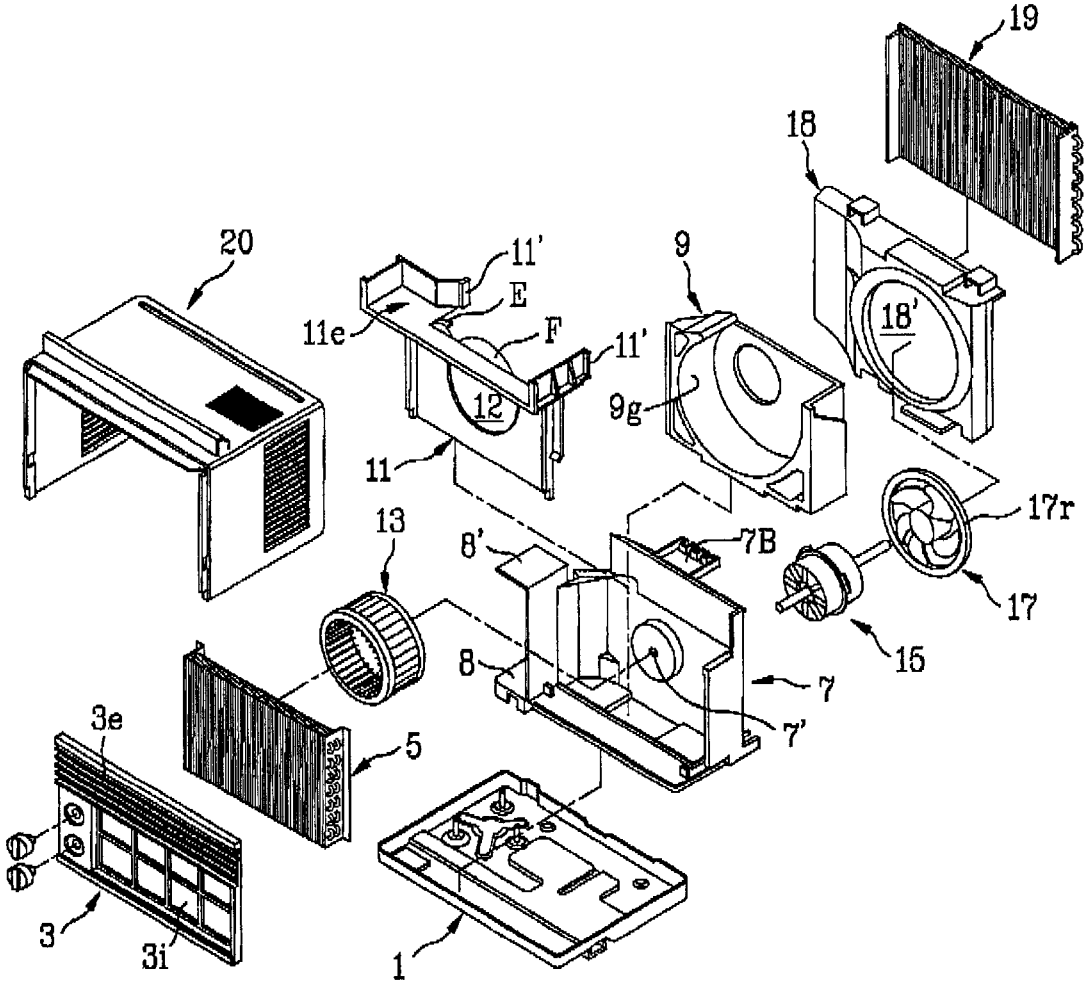
FIG. 1 Related Art
FIG. 1 illustrates a disassembled perspective view of a related art window type air conditioner.
Figure 2:
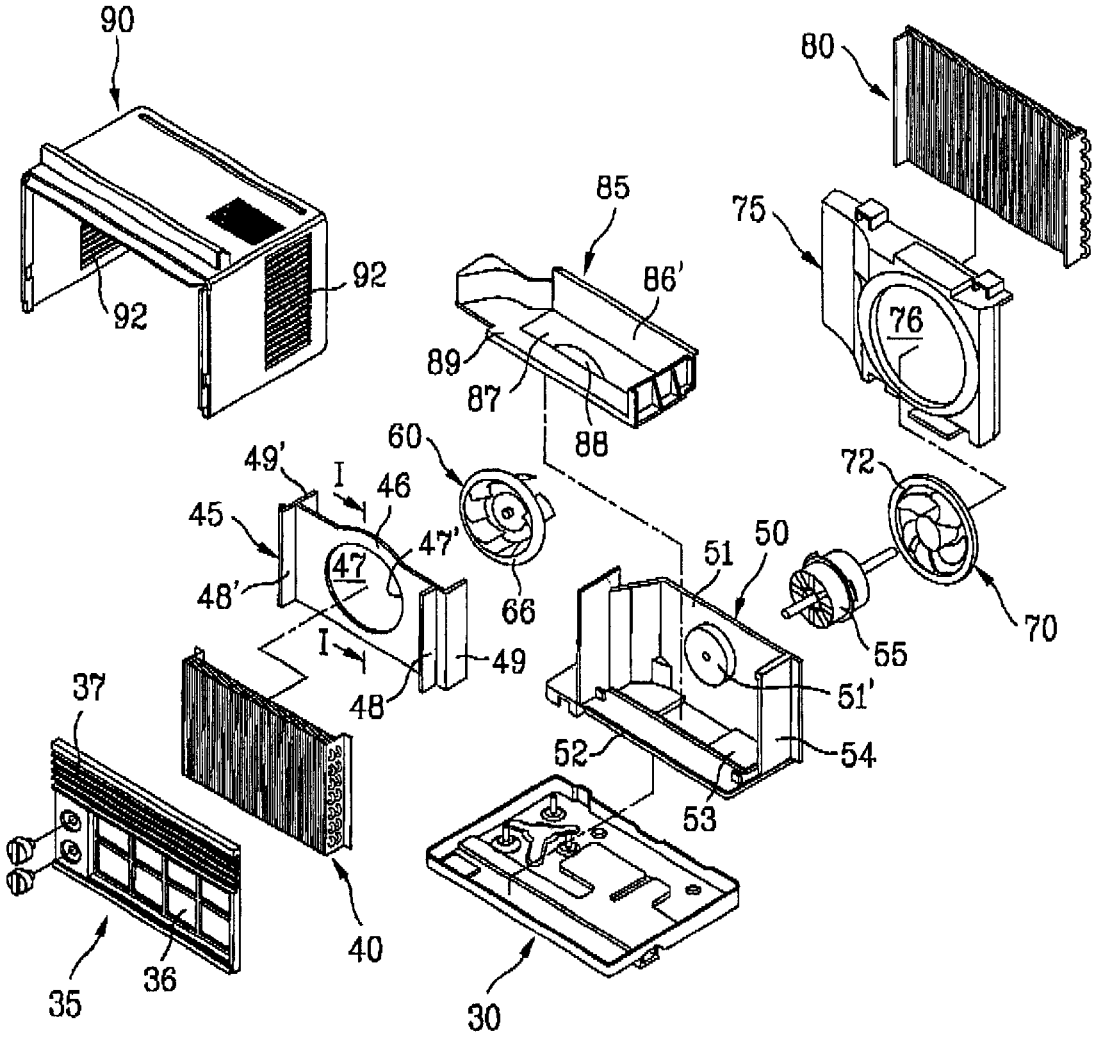
FIG. 2 illustrates a disassembled perspective view of a window type air conditioner in accordance with a first preferred embodiment of the present invention.

Reference will now be made in detail to the preferred embodiments of the present invention, examples of which are illustrated in the accompanying drawings. FIG. 2 illustrates a disassembled perspective view of a window type air conditioner in accordance with a first preferred embodiment of the present invention, referring to which an overall system of the window type air conditioner in accordance with a first preferred embodiment of the present invention will now be explained.

There is a base pan 30, a base of a window type air conditioner, on which different components of the air conditioner are fitted. There is a front grill 35 at a front (indoor side) of the base pan 30 having an inlet 36 in a lower portion and a discharge grill 37 in an upper portion. There is an indoor heat exchanger 40 opposite to the inlet 36 in rear of the front grill 35, and an orifice 45 in rear of the indoor heat exchanger 40 for guiding air passed through the indoor heat exchanger 40. The orifice 45 has an orifice hole 47 at a central portion for guiding the air passed through the indoor heat exchanger 40 to the turbo fan 60.

Figure 3:
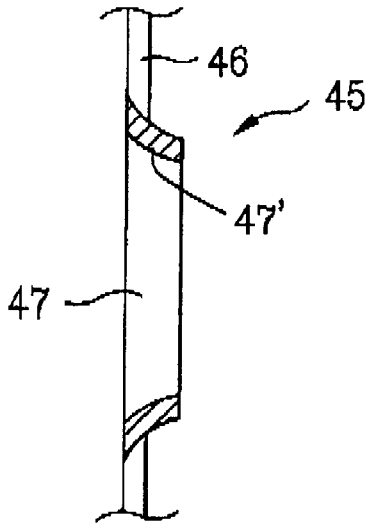
FIG. 3 illustrates a section across line I—I.
Figure 4:
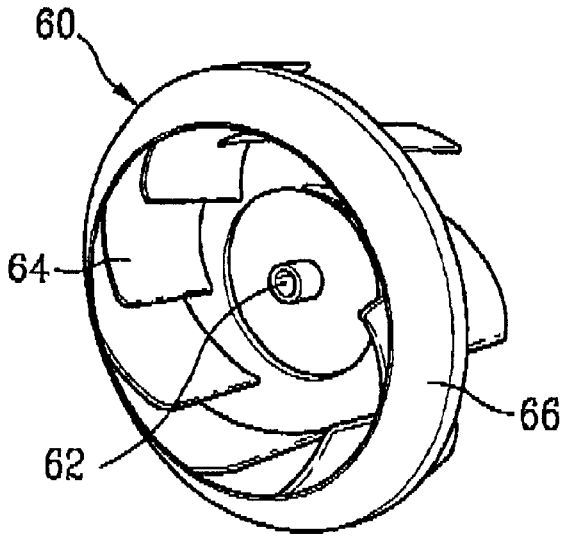
FIG. 4 illustrates a perspective view of the turbo fan in FIG. 2.
Figure 5:
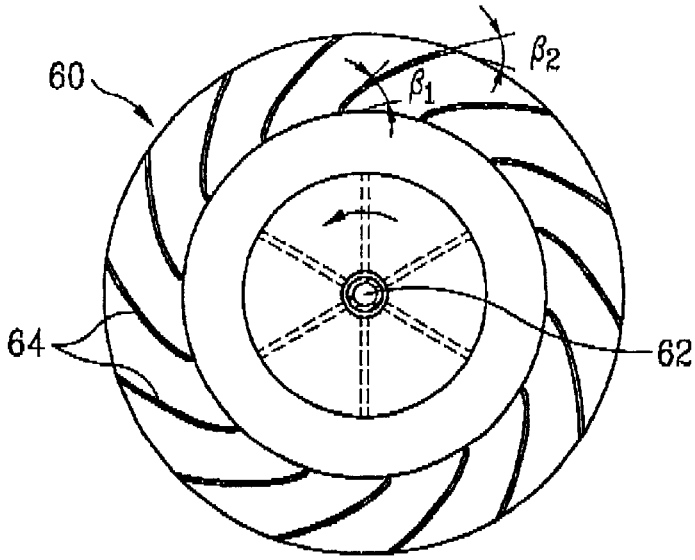
FIG. 5 illustrates a front view of the turbo fan in FIG. 4.
Figure 6:
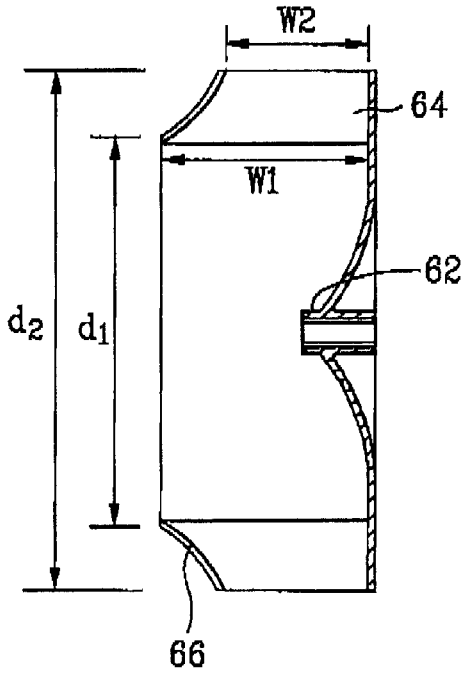
FIG. 6 illustrates a section of the turbo fan in FIG. 4.

The orifice 45 will now be explained in detail with reference to FIGS. 2 and 3.

The orifice 45 has a rectangular partition wall 46 for partitioning the indoor heat exchanger 40 and the turbo fan 60, and an orifice hole 47 in a central portion of the partition wall 46 for guiding air passed through the indoor heat exchanger 40 to the turbo fan 60. There is a nozzle portion 47' projected from an edge of the orifice hole 47 for insertion in the turbo fan 60. The partition wall 46 has first sidewalls 48 and 48' and second side walls 49 and 49' at both ends, respectively. The first sidewalls 48 and 48' coupled to both ends of the indoor heat exchanger 40 are for preventing air leakage from the vicinity of the orifice 45 and supporting and fastening the indoor heat exchanger 40 and components around the indoor heat exchanger 40. The second sidewalls 49 and 49' formed opposite to the first sidewalls 48 and 48' is coupled to the air guide 50 to form a flow path for the air guide 50. The orifice 45 is fitted to a central portion of a supporting plate 52 of the air guide 50, for partitioning an inside of the air conditioner into an indoor side and an outdoor side of the air conditioner.

A method for assembling the orifice 45 will now be explained.

The orifice 45 is fitted to the turbo fan 60 for obtaining maximum efficiency of the turbo fan 60. That is, the nozzle portion 47' of the orifice 45 is inserted toward an inner side of the shroud 66 for preventing leakage between the orifice 45 and the turbo fan 60. For firm coupling between the orifice 45 and the turbo fan 60, no structure is formed on top portion of the orifice 45, for permitting insertion of the orifice 45 from the front of the turbo fan 60, or to use the top-down fashion or sliding fashion in assembly of the orifice 45 to the turbo fan 60. In the sliding fashion, the orifice 45 is inserted from top to bottom between the turbo fan 60 and the indoor heat exchanger 40. In this instance, the nozzle portion 47' in the orifice required to be spaced from the turbo fan 60 for preventing interference. Then, when the nozzle portion 47' comes to face the turbo fan 60, the orifice 45 is pressed toward the turbo fan 60 so that the nozzle portion 47' of the orifice is inserted into inner side of the shroud 66 of the turbo fan 60. Since there is no other structure on top of the orifice 45, the assembly can be [done in] accomplished by a variety of methods, to permit a variety of methods and sequences in assembly of the orifice 45, that permits easy design of the orifice 45 and related components.

The air guide 50 will now be explained in detail with reference to FIG. 2.

The air guide 50 includes a partition plate 51 for partitioning the indoor side and outdoor side, and has a width fixed to correspond to a width of the indoor heat exchanger 40. The partition plate 51 has a motor setting part 51' projected forward in a central portion for setting the motor 55 therein, wherefrom one side of the rotation shaft of the motor 55 is passed and projected to the indoor side. There is a supporting plate 52 formed as a unit with the partition plate 51. The supporting plate 52 is set to the base pan 30, and the indoor heat exchanger 40 is set on the supporting plate 52. Detailed explanation of the setting of the indoor heat exchanger 40 will be omitted. A floor surface formed as the partition plate 51 and the supporting plate 52 meet together is a fan setting floor 53, a floor surface for space for the turbo fan 60 is provided therein. The air guide 50 has a sidewall 54 at one side in a vertical direction along a side of the partition plate 51 for forming the space for the turbo fan 60 to be set therein, in cooperation with the second sidewall 49 of the orifice 45. There is the motor 55 on the outdoor side of the air guide 50 for driving the turbo fan 60 and the fan 70, with a rotating shaft of the motor 55 projected in front and rear direction for rotating the turbo fan 60 and the fan 70 at the same time. Of course, the motor 55 may be fitted on an additional bracket depending on the design of the air conditioner. The turbo fan 60 fitted to the air guide 50 provides power for drawing room air through the inlet 36, passing the room air through the indoor heat exchanger 40 for heat exchange, and discharging the room air to the room. In the present invention, a turbo fan 60 is used instead of the sirocco fan, that requires no separate scroll for guiding the air flow, thereby permitting an inside structure of the air conditioner to be relatively simple.

The turbo fan 60 will be explained with reference to FIGS. 2~6.

The turbo fan 60 has a hub 62 in a central portion for connection to a rotating shaft of the motor 55. There is a plurality of blades 64 fitted along an end portion of a radial extension of the hub 62 perpendicular to a surface of the radial extension. The blade 64 has a blade outlet angle $\beta 2$ smaller than 90°, a ratio of outside diameter to inside diameter d1/d2 less than 0.8, a backward curved form, a structure in a direction of rotating stream line, and a larger inlet width W1 (at which the air is initially directed) than an outlet width W2. There is a shroud 66 on upper portions of the blades 64 as a unit with the blades 64, to connect all the blades 64 along side widths as the blades 64 become smaller. The shroud 66 guides the air flow along the blades 64, so that the air passing through adjacent blades is discharged at a desired pressure. The blade inlet angle $\beta 1$ at the hub 62 side and the blade outlet angle $\beta 2$ at the shroud 66 side may be formed differently, to form a uniform flow between the blades 64 to improve noise characteristics. On the other hand, as shown in FIG. 2, the fan 70 driven by the motor 55 is provided in the rear (outdoor side) of the air guide 50, with a ring 72 fitted to an outer end of the fan 70 for splashing condensate on a floor of the base pan 30 to the outdoor heat exchanger 80 during rotation of the fan 70. There is a fan shroud 75 in rear of the fan 70 for guiding an air flow formed by the fan 70. The fan shroud 75 is fitted on the base pan 30 and has a through hole 76 in a central portion. There is the outdoor heat exchanger 80 in rear of the shroud 75 fitted on the base pan 30.

Figure 7:
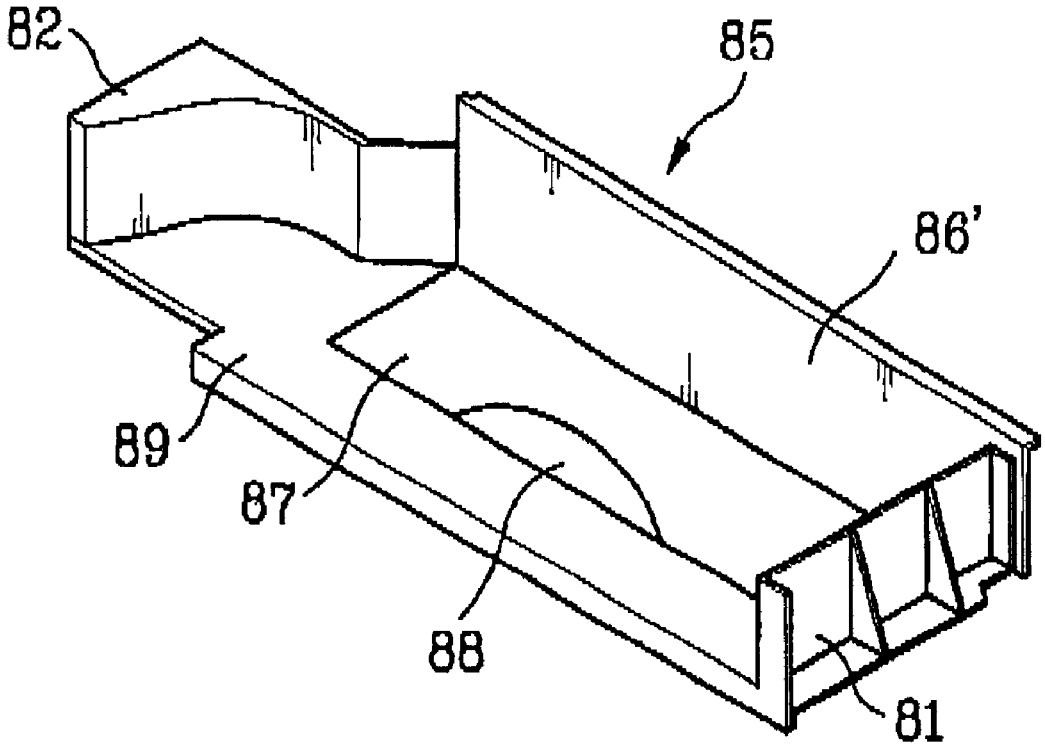
FIG. 7 illustrates a detailed perspective view of the discharge guide in FIG. 2.
Figure 8:
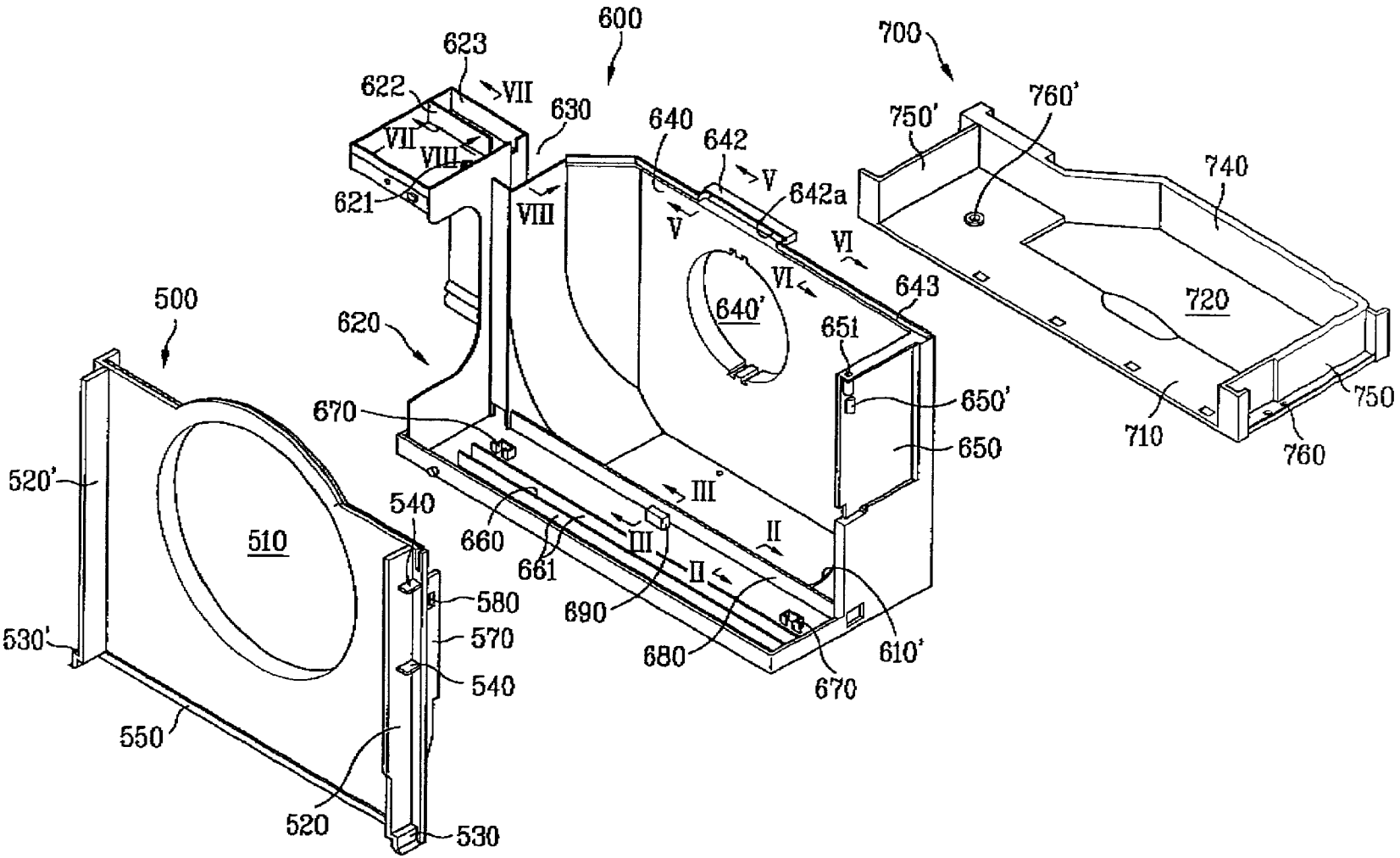
FIG. 8 illustrates a disassembled perspective view of an orifice and an air guide in a window type air conditioner in accordance with a second preferred embodiment of the present invention.
Figure 9:
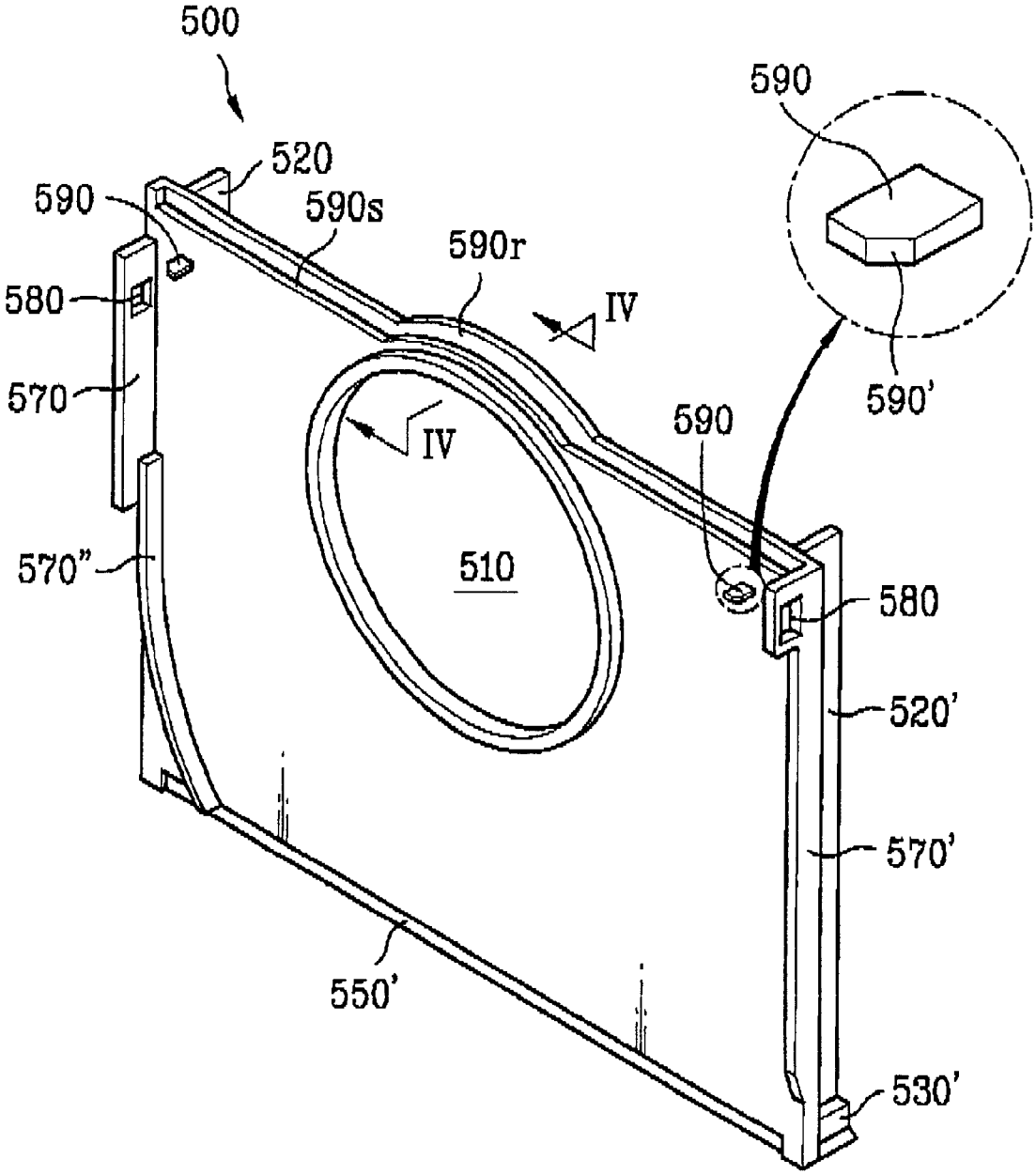
FIG. 9 illustrates a perspective back view of the orifice in FIG. 8.

The discharge guide 85 fitted on top of the air guide 50 for guiding the air from the turbo fan 60 to the discharge grill 37 will now be explained in detail with reference to FIGS. 2 and 7.

The discharge guide 85 includes a horizontal member 89, a partition wall 86' formed at a rear end of the horizontal member 89 substantially perpendicular thereto to partition the indoor side and the outdoor side, and sidewalls 81 and 82 on both sides of the horizontal member perpendicular to the horizontal member. The horizontal member 90 has a discharge part 87 in communication with an inside of the air guide 50. There is a finger guide 88 in front of the discharge part 87 for preventing touch to the turbo fan 60. The discharge guide 85 is fitted on top of the orifice 45 and the air guide 50. The discharge guide 85, the orifice 45 and the air guide 50 are coupled as one side is inserted to the other side. Accordingly, the discharge guide 85 serves to couple the orifice 45, the air guide 50 and the fan shroud 75, together.

Thus, by providing the discharge guide 85 separate from other components for guiding air flow formed by the turbo fan 60 of the window type air conditioner to the discharge grill 37, strength of the discharge guide is made stronger and assembly with neighbouring components is made perfect. That is, the discharge guide 85 is formed separate from other components, such as the orifice 45 and the air guide 50, and the partition wall 86' is provided thereto both for partitioning the indoor side and the outdoor side and reinforcing the strength of the discharge guide itself. Moreover, the discharge guide 85 is designed to be positioned on, and inserted into the orifice 45 and the air guide 50 so that the discharge guide 85 serves to hold many components provided below the discharge guide, firmly. The reinforcement of entire discharge guide 85 by connecting both ends of the discharge guide 85 with the partition wall 86' permits the elimination of an upper portion 8' of the control box storage part in the air guide 50 formed under the left portion of the discharge guide 85. The use of turbo fan 60 permits the white colored scroll to be dispensed with so as not to require the additional projection. That makes the structure simple. Finally, since the discharge guide 85 is separate to permit last (after other components), such as the air guide 50, the indoor heat exchanger 40, the orifice 45, the motor 55, the fan 70, the fan shroud 75, and the like are fitted, the assembly is simple. In disassembly too, access to components under the discharge guide 85 is easy when only the discharge guide 85 is disassembled.

The foregoing various components are protected from the outside by the outer case 90. The outer case 90 has air vent grills 92 for air flow in/from the air conditioner by the fan 70. The related art injection molded components, such as the orifice 45, the air guide 50, the fan shroud 75, the discharge guide 85, and the like, are formed by hyperfine foaming of polymer materials. In the hyperfine foaming, a fluid in a supercritical state is supplied to the polymer material before injection molding when relatively fine uniform foams are formed therein. The product formed by such a process has relatively small uniform foams inside of the product, to make the product light and strong, and enhance noise protection and insulating properties.

The operation of the air conditioner of the present invention having the foregoing system will now be explained, taking a cooling operation as an example.

Upon putting the air conditioner into operation, the turbo fan 60 is operated to draw room air through inlet 36 in the front grill 35. The drawn air is heat exchanged at the indoor heat exchanger 40 into a low temperature, low humidity air, and passes through the orifice hole 46. Then, the air is drawn toward the rotation shaft of the turbo fan 60, flows along the blade 64, and discharged in a circumferential direction the turbo fan 60 is rotated. The shroud 66 on the turbo fan 60 guides the air to flow between adjacent blades 64, to be able to form an air flow even if there is no separate air flow guide and to discharge the air from the turbo fan 60 directly, and provide the air to the entire discharge part 87 above the turbo fan 60. The air flow is discharged, not from the direction of the discharge part 87, but from a lower portion of the air guide 50, and is also discharged along the direction of rotation of the turbo fan 60 and provided to the discharge part 87. The air thus discharged to the discharge part 87 is provided to the discharge guide 85. That is, the air flows to the discharge guide 85 through the discharge part 87, guided along the horizontal member 89, provided to the discharge grill 37, and therefrom into the room. The air discharged throughout the discharge part 87 is also discharged throughout the entire discharge grill 37.

Since a heat exchange process at the outdoor heat exchanger 80 is similar to the case of the related art, explanation thereof will be omitted.

As has been explained, the window type air conditioner in accordance with the first preferred embodiment of the present invention has the following advantages.

First, since the shroud on the turbo fan itself serves to form an air flow, requiring no further structure for forming the air flow, a structure of the air conditioner can be made simple. Since partial air flow concentrated to one side is avoided, the air can be discharged into the room throughout the entire discharge grill. Since the air flow formed by the turbo fan does not interfere with rotation of the turbo fan, with reduction of factors that act as resistance to the turbo fan rotation, power consumption of the turbo fan can be reduced.

Second, the formation of no other structure on the orifice permits to employ a variety of assembly methods and sequences. The coupling between the orifice and the turbo fan in a manner whereby one side is inserted into an inside of the other prevents air leakage therethrough, thereby maximizing turbo fan efficiency.

Third, by separating the discharge guide from other components and reinforcing the discharge guide itself, a system of other related components is simplified. Accordingly, the simplified components of the air conditioner permit easy assembly and disassembly at large. Also, component design and production are made simple. The separation of the discharge guide, which permits assembly or disassembly of the discharge guide independent from those components fitted under the discharge guide, permits easy access to the other components once the discharge guide is removed, thereby permitting easy maintenance of the air conditioner. The discharge guide strengthens the air conditioner on the whole as the discharge guide couples components under the discharge guide together after all the components are fitted.

Second embodiment orifice and air guide of the air conditioner of the present invention will now be explained with reference to the attached drawings.

First, the orifice 500 will be explained.

Referring to FIGS. 8~13, the orifice 500 has an orifice hole 510 in a central portion for guiding air being heat exchanged at an indoor heat exchanger to a turbo fan (not shown) inside of a lower air guide (600). There is a sealing ridge 520 and 520' extended throughout a height of the orifice 500 and projected forward from each end of the orifice 500, for bringing opposite channels of the indoor heat exchanger into close contact with outer surfaces of the sealing ridges 520 and 520'. The sealing ridge 520 or 520' has a toe 530 or 530' for covering both ends of a catch 670 and 670' on the lower air guide 600 to prevent air leakage. The catches 670 and 670' are provided for inserting lower ends of the indoor heat exchanger. The sealing ridges 520 and 520' have a plurality of reinforcing stoppers 540 for securing straightness of the sealing ridges 520 and 520' and positioning the indoor heat exchanger. That is, the reinforcing stoppers 540 reinforce strength of the sealing ridge 520 and 520' for preventing formation of gaps between the indoor heat exchanger and the channels. There is an overlap part 550 extended in left and right directions at a lower end of the orifice 500, for making a close contact with a sill 680 of the lower air guide 600, which will be explained, later. The overlap part 550 has a seating part 550' formed in a width direction at a lower surface thereof for making a close contact with the sill 680, which is shown the most clearly in FIG. 11. Next, there is a sealing plate 570 or 570' projected backward from each side of the orifice 500 and extended from top to bottom, wherein the plate 570 at one side thereof is extended only down to halfway, for making close contact with sidewalls 650 of the lower air guide 600. The sealing plate 570 or 570' has a catch hole 580 for inserting a catch projection 650' on the lower air guide 600. There is another catch projection 590 on a back surface of the orifice 500 adjacent to the catch hole 580 for guiding insertion of the orifice 500 into the lower air guide 600, and falling off the lower air guide 600 after the orifice 500 is coupled to the lower air guide 600. The catch projection 590 is formed with a gap to the sealing plate 570 or 570' and has a guide slope 590' for guiding a fore-end of the sidewall 650 of the air guide 600. There is a sloped sealing strip 570" having a curvature corresponding to a curvature of the guide surface on a back surface of the orifice 500 for making close contact with a guide surface 610' of the air guide 600, to prevent leakage of air. There is a seating step **590*s* extended in left and right directions on top of the orifice 500 for coupling with an upper air guide 700 (to be explained later). The seating step 590*s* has a round part 590*r* projected upward at a position corresponding to the orifice 510**.

Figure 12:
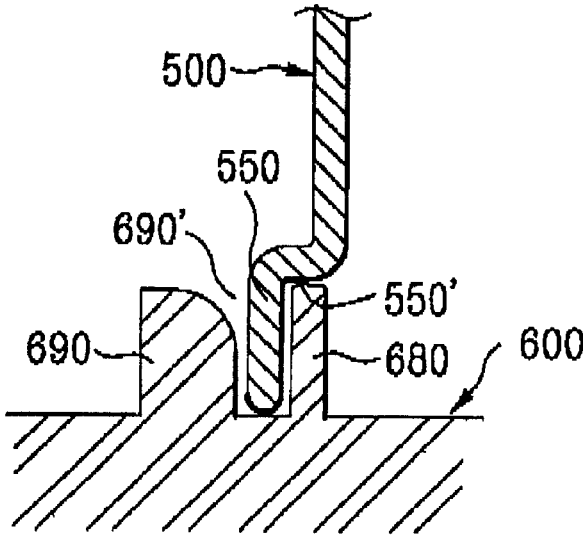
FIG. 12 illustrates a section across III—III in FIG. 8 showing a state an overlap portion of the orifice is set between a catch rib and a setting end of the lower air guide.

The lower air guide 600 will now be explained. The lower air guide 600 has a flow path forming part 610, a control box seating part 620, and a pipe seating part 630. The flow path forming part 610 has a guide surface 610' formed along both sides thereof, and is a part for accommodating a turbo fan which forms an air flow in the indoor side. The air guide 600 has a rear wall 640 which forms a rear surface of the air guide 600 and serves to partition an inside of the air conditioner into the indoor side and the outdoor side. There is a motor hole 640' for mounting a motor (not shown) formed in the rear wall 640. The control box seating part 620 is used for placing a control box (not shown) for controlling operation of the air conditioner. There is a holding slot piece 642 having a holding slot **642*a* on a center of top of the rear wall 640, and a sealing ridge 643 extended on both sides of the holding slot piece 642 along the top of the rear wall 640. There are reinforcing ribs 622 and 623 at rear of top of the control box seating part 620 opposite and parallel to, and distanced from each other. That is, the reinforcing ribs 622 and 623 are formed at the rear and the top of the control box seating part 620 in a lateral direction. Sides of the lower air guide 600 form sidewalls 650. The sidewall 650 has a catch projection 650' to be inserted in the catch hole 580 formed at a corresponding position. Though a backside structure of the sidewall 650 is not shown in the drawing, there is also a catch projection 650' on an outer side of the flow path forming part 610 adjacent to the pipe seating part 630. There is a fastening hole 651 at the top of the sidewall 650 for fastening firmly with the upper air guide 700. There is a drain part 660 at a lower part of front of the lower air guide 600 for draining condensate formed in the indoor heat exchanger. The drain part is formed between two ribs 661 supporting a bottom of the indoor heat exchanger. A bottom surface of the drain part 660 is sloped from one side to the other side for easy of draining. The catches 670 and 670' are projected from a floor of the lower air guide 600 at both ends of the drain part 660 for placing channels of the indoor heat exchanger thereon. The sill 680 is formed in a lateral direction extended in left and right directions between the drain part 660 and the rear wall 640 for seating the seating part 550' of the orifice 500. The sill 680 forms a boundary that separates a space for mounting the indoor heat exchanger and a space for mounting the turbo fan. There is a stopper 690 on a drain part 660 side of the sill 680 on middle of the sill 680 with a gap to the sill 680. The stopper 690 has a curved part 690' at one side of top of the stopper 690 facing the sill 680 for guiding insertion of the overlap part 550 of the orifice 500. The stopper 690 guides the center of the overlap part 550 at a lower part of the orifice 500, and restrains the overlap part 550 in an assembled state so that the overlap part 550 does not fall off its position. A relative structure of the stopper 690 and the overlap part 550 is shown in FIG. 12**.

Next the upper air guide 700 fitted on the top of the lower air guide 600 will be explained.

Figure 10:
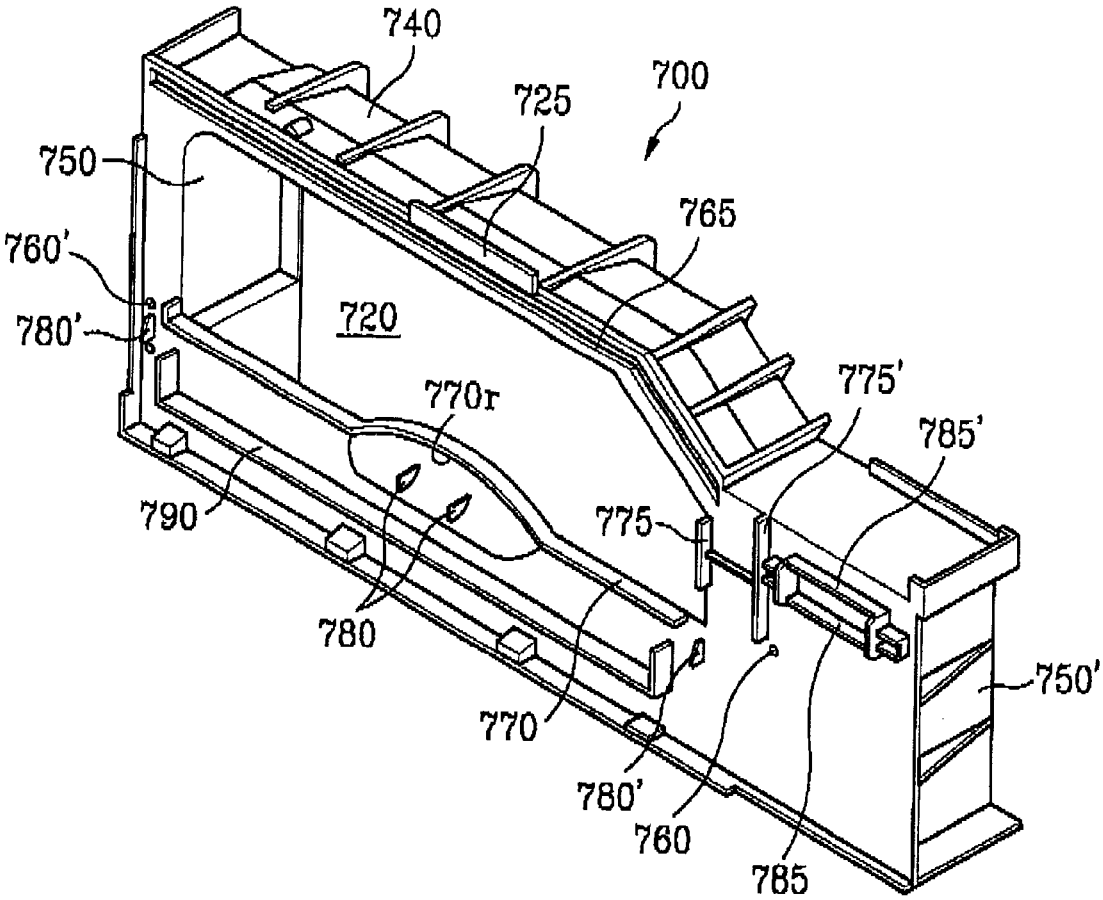
FIG. 10 illustrates a perspective bottom view of the upper air guide in FIG. 8.
Figure 11:
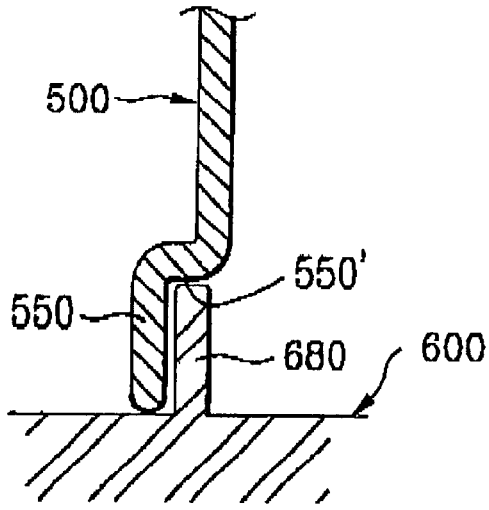
FIG. 11 illustrates a section across II—II in FIG. 8 showing a state an overlap portion of the orifice and a setting end of the lower air guide are coupled.
Figure 13:
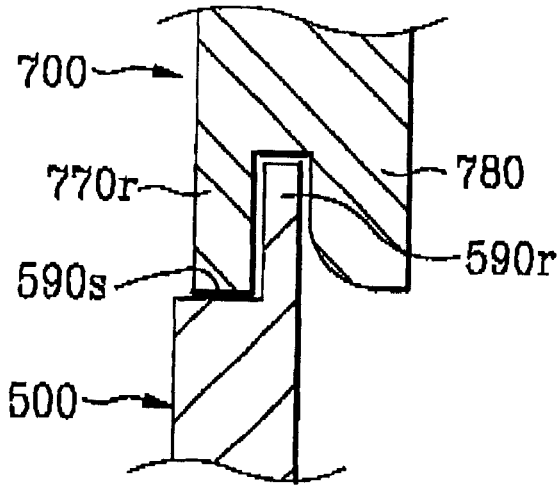
FIG. 13 illustrates a section across IV—IV in FIG. 9 showing a state in which a setting step portion of the orifice and a setting projection portion of the upper air guide are assembled.
Figure 14:
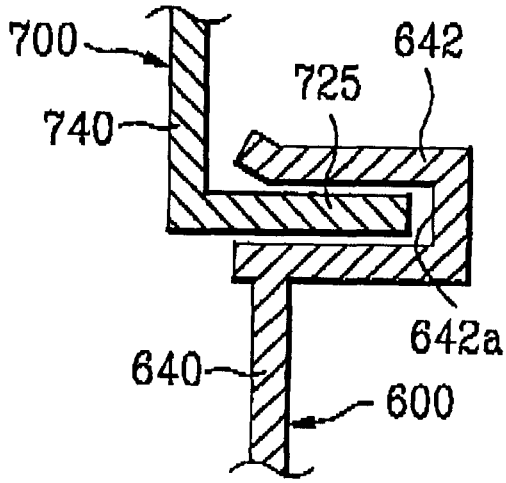
FIG. 14 illustrates a section across V—V in FIG. 8 showing a state in which a catch piece of the upper air guide and a holding slot in the lower air guide are assembled.
Figure 15:
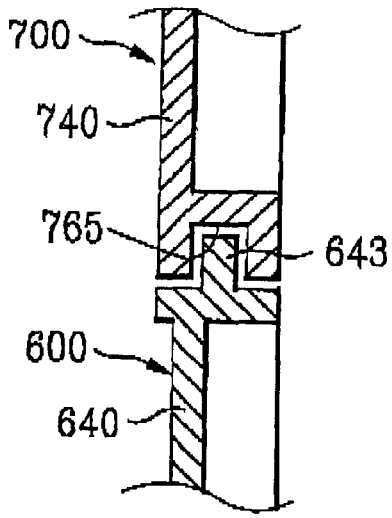
FIG. 15 illustrates a section across VI—VI in FIG. 8 showing a state in which a sealing ridge of the lower air guide and an insertion rib of the upper air guide are assembled.
Figure 16:
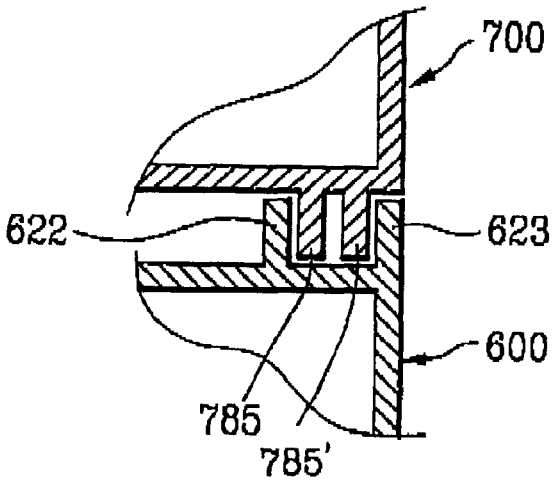
FIG. 16 illustrates a section across VII—VII in FIG. 8 showing a state in which an insertion rib of the lower air guide and a reinforcing rib of the upper air guide are assembled; and, FIG. 17 illustrates a section across VIII—VIII in FIG. 8 showing a state in which a pipe setting portion of the lower air guide and a supporting rib of the upper air guide are assembled.
Figure 17:
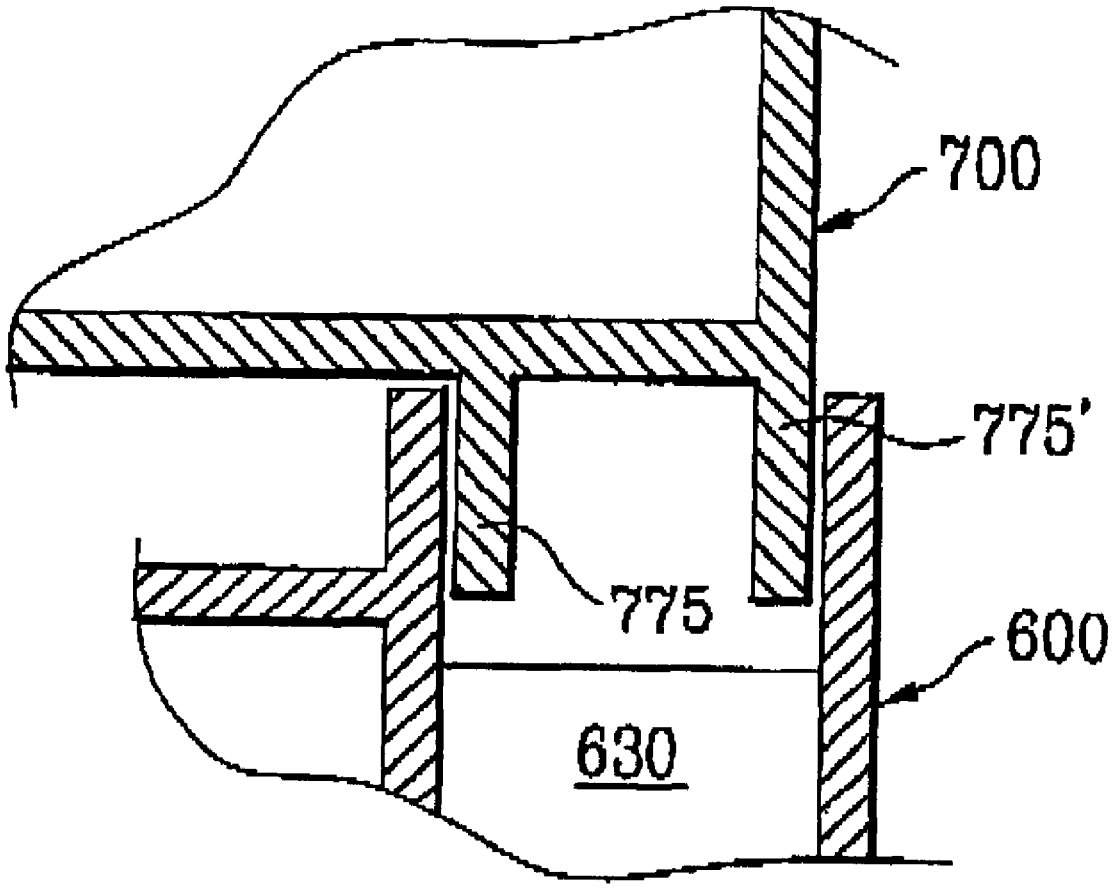

The upper air guide 700, provided for guiding the air passed through the lower air guide to a space to be air conditioned again, has a floor plate 710 to be positioned on the top of the lower air guide 600. The floor plate 710 has a communication part 720 for facilitating communication between an inside of the lower air guide 600 and the upper air guide 700. The communication part 720 serves to guide the air passed through the lower air guide 600 to the space to be air conditioned. There is a rear wall 740 at rear of the floor plate 710, in correspondence to the rear wall 640 of the lower air guide 600 for separating indoor side from an outdoor side. There are side walls 750 and 750' formed at both ends of the rear wall 740. A front and a top between the sidewalls 750 and 750' are opened. The reference numerals 760 and 760' represent fastening holes for fastening the upper air guide with the lower air guide 600, wherein the fastening hole 760' is formed at a position corresponding to a position of the fastening hole 621 in the lower air guide, and the fastening hole 760 in a bottom of the sidewall 750 of the upper air guide 700 is formed at a position corresponding to a position of the fastening hole 651 of the lower air guide. There is provision on the bottom of the floor plate 710 for fastening with the orifice 500. At first, there is a long downward seating ridge 770 on an edge of one side of the communication part 720 at a position corresponding to the top of the orifice 500, for seating on the seating step **590*s* in the orifice 500. The seating ridge 770 has a round part 770*r* corresponding to the round part 590*r*. There is an insertion guide 780 at a position corresponding to the round part 770*r*. The insertion guide 780, having a function identical to the stopper 690, guides insertion of the upper air guide 700 and holds the orifice 500 in place in a fastened state. The foregoing structure is shown in FIG. 13. As shown in FIG. 10, there are end insertion guides 780' in the vicinity of the seating ridge 770 for guiding insertion of both ends of the orifice when the upper air guide 700 is set on the orifice 500. The end insertion guides 780' guides coupling between the upper air guide 700 and the orifice 500 by guiding both sides of top of the orifice, and maintains a coupled state firmly after the coupling. Next, there is a guide ridge 790 on the bottom of the upper air guide 700 such that the guide ridge 790 is closely fitted to a front surface and both sides of the indoor heat exchanger for supporting the indoor heat exchanger. There is an insertion slot 765 along a bottom surface of the rear wall 740 of the upper air guide 700 for inserting the sealing ridge 643 of the lower air guide 600. The insertion slot 765 is extended in a lateral direction on both sides of a holding piece 725 to be inserted in the holding slot 642***a* to be matched to the sealing ridge 643. A state of coupling between the holding slot 642*a* in the holding slot piece 642 and the holding piece 725 is best shown in FIG. 14, and a state of coupling between the insertion slot 765 and the sealing ridge 643 is best shown in FIG. 15. There are supporting ribs 775 and 775' on a bottom surface of the upper air guide 700 at positions corresponding to the pipe seating part 630 in parallel to each other for supporting inside walls on both sides of the pipe seating part 630. As shown in FIG. 17, pipes connecting components of a heat exchanging cycle fitted on the indoor side and the outdoor side are passed through the supporting ribs 775 and 775'. Next, there are insertion ribs 785 and 785' on a bottom surface of the upper air guide 700 at positions corresponding to the control box seating part 620 for inserting between the reinforcing ribs 622 and 623. The coupling between the reinforcing ribs 622 and 623 and the inserting ribs 785 and 785' is best shown in FIG. 16.

The assembly and work of the window type air conditioner having an orifice and air guides in accordance with a second preferred embodiment of the present invention will now be explained.

First, coupling of the orifice 500 to the lower air guide 600 will be explained. First, bottom of the orifice 500 is inserted between the sill 680 of the lower air guide 600 and the stopper 690, to seat the seating part 550' on top of the sill 680, when the overlap part 550 is guided by the curved part 690' of the stopper 690 into an accurate position. When the seating part 550' is seated on the sill 680, the toes 530 and 530' are placed on both ends of the catches 670 and 670', thereby preventing leakage. Next, the catch projection 650' on the sidewall 650 is inserted into the catch hole 580 in the sealing plates 570 and 570' at both sides of the orifice 500, by pressing a top of the orifice 500 toward the lower air guide 600, when the sidewalls 650 are guided by the guide slope 590' formed at the catch projections 590 on the orifice 500, to induce an accurate coupling between them. The catch projections 590 hold the orifice in position after the orifice 500 and the lower air guide 600 are coupled. Thus, once the catch projections 650' are inserted in the catch holes 580 respectively, the sealing plates 570 and 570' come into close contact with outer surface of the sidewalls 650, to prevent leakage between the orifice 500 and the lower air guide 600. On the other hand, the sloped sealing plate 570" of the orifice 500 makes close contact with the guide surface 610' on one side of the lower air guide 600, to prevent leakage. The sloped sealing strip 570" is provided because the sealing plate 570 is formed down to a halfway point of the height of the orifice 500.

Next, coupling of the upper air guide 700 and the lower air guide 600, and coupling of the upper air guide 700 and the orifice 500, which separate indoor side from the outdoor side and guiding indoor side air flow will be explained.

First, a structure formed in a top portion of the rear wall 640 of the lower air guide 600 and a structure formed in a lower portion of the rear wall 740 of the upper air guide 700 are coupled together. That is, the holding piece 725 of the upper air guide 700 is inserted into the holding slot 642*a* in the holding slot piece 642 on the lower air guide 600, when the holding piece 725 is inserted in the holding slot piece 642 with a slope, but not fully into the holding slot 642*a*. Under this state, a fore end of the upper air guide 700 is pressed centered on a middle of the holding piece 725, such that the upper air guide 700 is set on the lower air guide 600 as the sealing ridge 643 on the lower air guide 700 is inserted into the insertion slot 765 in the bottom of the upper air guide 700 (as shown in FIG. 15). The supporting ribs 775 and 775' are brought into close contact with inside walls of the pipe seating part 630, into a state as shown in FIG. 17. The insertion ribs 785 and 785' are inserted into the reinforcing ribs 622 and 623, into a state as shown in FIG. 16. On the other hand, when the fore end of the upper air guide 700 is pressed centered on the holding piece 725 such that the upper air guide 700 is set on the top of the lower air guide 600, the upper air guide 700 and the lower air guide 600 are assembled as the seating step 590*s* at the top of the orifice 500 is guided by the insertion guides 780, and both ends of the orifice 500 are guided by the end insertion guides 780'. That is, the seating ridge 770 is set on the seating step 590*s*, bringing a step surface of the seating step 590*s* into close contact with a side surface of the seating ridge 770, to make [a] surface to surface contact between the step surface and the side surface, thereby preventing leakage and relative bending. In this instance, the round part 770*r* of the seating ridge 770 is set on the round part 590*r* of the seating step 590*s*. The insertion guides 780 sustain the seating step 590*s* of the orifice 500 to be in close contact with the seating ridge 770. Both ends of the top of the orifice 500 are supported in side directions of the seating ridge 770 by the end insertion guides 780'. Accordingly, the coupling between the orifice 500 and the upper air guide 700 are made firm enough to prevent leakage and relative bending. Upon the upper air guide 700 is set on the lower air guide 600 and the orifice 500, fastening screws (not shown) are fastened into the fastening holes 651 and 621 through the fastening holes 760 and 760', for positive coupling of the lower air guide 600, the upper air guide 700 and the orifice 500.

The second embodiment of the present invention has the following advantages.

The structure of orifice fitting in the window type air conditioner in accordance with a second preferred embodiment of the present invention can prevent leakage as the orifice, the upper air guide and the lower air guide make surface to surface contact, and can prevent relative bending between them by a structure designed to make insertion guide and reinforcement.

It will be apparent to those skilled in the art that various modifications and variations can be made in the window type air conditioner of the present invention without departing from the spirit or scope of the invention. Thus, it is intended that the present invention cover the modifications and variations of this invention provided they come within the scope of the appended claims and their equivalents.

What is claimed is:

1. A window type air conditioner comprising:

an indoor heat exchanger for heat exchange with room air;

an outdoor heat exchanger for heat exchange with external air;

an air guide for partitioning a space for fitting the indoor heat exchanger and a space for fitting the outdoor heat exchanger;

a turbo fan fitted inside of the air guide directly, for discharging the room air heat exchanged as the room air passes through the indoor heat exchanger into the room, again; and, a fan fitted to outside of the air guide for discharging the external air heat exchanged as the external air passes through the outdoor heat exchanger, again.

2. A window type air conditioner as claimed in claim 1, wherein the air guide includes;

a partition plate having the turbo fan fitted in a central portion and partitioning the indoor heat exchanger and the outdoor heat exchanger, and sidewall parts at both sides of the partition plate substantially perpendicular to the partition plate.

3. A window type air conditioner as claimed in claim 1, further comprising an orifice between the indoor heat exchanger and the turbo fan for effective guidance of the air passed through the indoor heat exchanger.

4. A window type air conditioner as claimed in claim 1, further comprising a discharge guide on the air guide for effective guide of the room air from the turbo fan to the room.

5. A window type air conditioner comprising:

an indoor heat exchanger for heat exchange with room air;

an outdoor heat exchanger for heat exchange with external air;

a lower air guide for separating a space the indoor heat exchanger is mounted therein from a space the outdoor heat exchanger is mounted therein;

an orifice fitted at a front of the lower air guide for guiding the air passed through the indoor heat exchanger to an inside of the lower air guide;

an upper air guide assembled to a top of the lower air guide to make surface to surface contact with the orifice and the upper air guide;

a turbo fan directly fitted to an inside of the lower air guide for discharging the air having a heat exchanged as the air passes through the outdoor heat exchanger into a room again; and, a fan fitted outside of the lower air guide for discharging the air having a heat exchanged as the air passes through the outdoor heat exchanger to outside of room again.

6. A window type air conditioner as claimed in claim 5, wherein the orifice includes an orifice hole formed at a central portion thereof for guiding air flow, and a seating step formed along top thereof with a step, and the upper air guide formed to match to the seating step, such that the upper air guide includes a seating ridge having a lower end for seating on the seating step and a side for making a close contact with a side of the seating step.

7. A window type air conditioner as claimed in claim 6, wherein the seating step formed in top of the orifice includes a round part, and the upper air guide includes a round part at a lower surface thereof matched to the round part of the seating step in the orifice and insertion guides formed on the round part on the lower surface of the upper air guide matched to the round part of the upper air guide for guiding insertion of the seating step and supporting the seating step.

8. A window type air conditioner as claimed in claim 5, wherein the upper air guide includes end insertion guides in positions matched to the seating ridge for guiding insertion of both ends of top of the orifice, and maintaining a coupled state firmly after the coupling.

9. A window type air conditioner comprising:

an indoor heat exchanger for heat exchange with room air;

an outdoor heat exchanger for heat exchange with external air;

a lower air guide for separating a space the indoor heat exchanger is mounted therein from a space the outdoor heat exchanger is mounted therein;

an orifice fitted at a front of the lower air guide for guiding the air passed through the indoor heat exchanger to an inside of the lower air guide;

an upper air guide assembled to a top of the lower air guide to make surface to surface contact with the orifice and the upper air guide;

leakage preventing means provided at matched positions of a rear wall of the lower air guide and a rear wall of the upper air guide, the rear wall of the lower air guide being provided for partitioning an indoor side and an outdoor side, and the rear wall of the upper air guide is provided for partitioning an indoor side and an outdoor side;

a turbo fan directly fitted to an inside of the lower air guide for discharging the air having a heat exchanged as the air passes through the outdoor heat exchanger into a room again; and, a fan fitted outside of the lower air guide for discharging the air having a heat exchanged as the air passes through the outdoor heat exchanger to outside of room again.

10. A window type air conditioner as claimed in claim 9, wherein the leakage preventing means includes;

a holding slot opened in a horizontal direction in a central top surface of the rear wall of the lower air guide, a holding piece projected backward from the rear wall of the upper air guide at a position matched to the holding slot for being held by the holding slot in the lower air guide, a sealing ridge extended along the top of the rear wall of the lower air guide, an insertion slot in a bottom surface of the rear wall of the upper air guide at a position matched to the sealing ridge for insertion of the seating ridge thereto, reinforcing ribs at top of the control box seating part opposite to each other, and insertion ribs at positions matched to the reinforcing ribs for inserting between the reinforcing ribs.

11. A window type air conditioner as claimed in claim 10, wherein the upper air guide includes opposite supporting ribs on one side of a bottom surface thereof for inserting into the pipe seating part of the lower air guide to support between the control box seating part and one sidewall of the lower air guide.

12. A window type air conditioner as claimed in claim 9, wherein the leakage preventing means further includes;

a sill projected from a lower surface of, and extended in left and right directions on the lower air guide, an overlap part having a seating part formed as a step to make a surface to surface contact with the sill for seating on a top of the sill, and a stopper for guiding the overlap part toward the sill, and supporting the overlap part toward the sill when coupled.

13. A window type air conditioner as claimed in claim 9, wherein the leakage preventing means further includes;

sealing plates formed on both sides of the orifice in up and down directions for making close contact with sides of the lower air guide, and a sloped sealing strip formed on a rear surface of the orifice in a form to be matched to guide surface formed in an inside space of the lower air guide for making a surface to surface contact with the guide surface.

14. A window type air conditioner as claimed in claim 9, wherein the leakage preventing means further includes;

catch projections formed on both sides of the lower air guide, catch holes formed in the sealing plates of the orifice to be matched with the catch projections, and another catch projections on a back surface of the orifice opposite to the sealing plates each with a gap to the sealing plate the same with a thickness of the sidewall of the lower air guide.

15. A window type air conditioner as claimed in claim 9, wherein the leakage preventing means further includes toes on lower ends of the orifice for covering both ends of catches on the lower air guide to prevent air leakage.

16. A window type air conditioner as claimed in claim 9, wherein the orifice flirter includes sealing ridges projected forward from both sides of the orifice for making close contact with channels on both sides of the indoor heat exchanger.

17. A window type air conditioner as claimed in claim 16, wherein the sealing ridge includes a plurality of reinforcing stoppers for securing straightness of the sealing ridges and defining a mounting position of the indoor heat exchanger, to prevent gap formation between the channel of the indoor heat exchanger and the sealing ridge.

18. A window type air conditioner comprising:

an indoor heat exchanger for heat exchange with room air;

an outdoor heat exchanger for heat exchange with external air;

an air guide having no annular portion, for partitioning a space for fitting the indoor heat exchanger and a space for fitting the outdoor heat exchanger;

a turbo fan fitted inside of the air guide, directly, for discharging the room air heat exchanged as the room air passes through the indoor heat exchanger into the room; and a fan fitted to the outside of the air guide for discharging the external air being heat exchanged as the external air passes through the outdoor heat exchanger.

19. A window type air conditioner as claimed in claim 18, further comprising a discharge guide on the air guide for effective guide of the room air from the turbo fan to the room.

20. A window type air conditioner comprising:

an indoor heat exchanger for heat exchanging indoor room air;

an outdoor heat exchanger for heat exchanging outdoor air;

an air guide, forming a partition for an indoor side for fitting the indoor heat exchanger and an outdoor side for fitting the outdoor heat exchanger;

a turbo fan, directly installed on the inside of the air guide, for discharging heat exchanged room air as it passes through the indoor heat exchanger into an indoor room;

a fan, installed on the outdoor side of the air guide for discharging external air that is heat exchanged as it passes through the outdoor heat exchanger; and an orifice, between the indoor heat exchanger and the turbo fan for effective guidance of air passed through the indoor heat exchanger, said orifice including a partition wall having an orifice hole formed therein for passing air therethrough, and coupling parts formed at both sides of, and substantially perpendicular to the partition wall, having one side coupled to both ends of the indoor heat exchanger, and the other end coupled to both ends of the air guide.

* * * * *